US006726461B2

(12) United States Patent
Hyvarinen et al.

(10) Patent No.: US 6,726,461 B2
(45) Date of Patent: Apr. 27, 2004

(54) SCREEN PIPE FOR DRY FORMING WEB MATERIAL

(75) Inventors: Paavo Hyvarinen, Kotka (FI); Heikki Niranen, Hameenlinna (FI)

(73) Assignee: BKI Holding Corporation, Wilmington, DE (US)

( * ) Notice: Subject to any disclaimer, the term of this patent is extended or adjusted under 35 U.S.C. 154(b) by 57 days.

(21) Appl. No.: 09/988,897

(22) Filed: Nov. 19, 2001

(65) Prior Publication Data

US 2002/0063362 A1 May 30, 2002

Related U.S. Application Data

(63) Continuation of application No. PCT/US00/14631, filed on May 26, 2000.

(30) Foreign Application Priority Data

May 27, 1999 (FI) ..... 991203 U

(51) Int. Cl.[7] ..... B27N 1/00

(52) U.S. Cl. ..... 425/80.1; 425/83.1; 264/121; 19/65 A; 19/296

(58) Field of Search ..... 425/80.1, 81.1, 425/82.1, 83.1; 264/114, 121, 518; 19/65 A, 161.1, 296, 301, 302

(56) References Cited

U.S. PATENT DOCUMENTS

| | | | | |
|---|---|---|---|---|
| 2,738,557 A | 3/1956 | Anderson et al. | ..... | 19/156 |
| 2,931,076 A | 4/1960 | Clark | ..... | 19/156 |
| 3,145,430 A | 8/1964 | Caron | | |
| 3,914,080 A | 10/1975 | Kamp | | |
| 4,352,649 A | 10/1982 | Jacobsen et al. | | |
| 4,640,810 A | 2/1987 | Laursen et al. | ..... | 264/518 |
| 4,732,552 A | 3/1988 | Chung | ..... | 425/82.1 |
| 5,810,902 A | 9/1998 | Brown et al. | ..... | 65/447 |

FOREIGN PATENT DOCUMENTS

| | | |
|---|---|---|
| EP | 0 032 772 | 7/1981 |
| EP | 0 345 234 | 12/1989 |

*Primary Examiner*—James P. Mackey
*Assistant Examiner*—Donald Heckenberg
(74) *Attorney, Agent, or Firm*—Darby & Darby

(57) ABSTRACT

The invention relates to a screen pipe to be used in dry forming of web material in order to distribute fiber material blown into the screen pipe through a jacket (2) of the pipe onto a wire arranged to move under the pipe. The fiber material provided inside the screen pipe is made to move for example by means of a spiked roll placed inside the pipe, so that the movement of the fiber material has both a radial and a tangential component with respect to the jacket (2) of the screen pipe. The jacket comprises on its inner surface profiled grooves (8) in the pipe's axial direction. The edge (8*a*) of the profiled groove is situated downstream with respect to the tangential component of the fiber flow. The upstream edge (8*b*) of the groove is positioned downstream with respect to the tangential component of the fiber flow. The bottoms of the profiled grooves comprise holes or slots (9) through which the fibers are discharged from the screen pipe. In the invention, the downstream edge (8*a*) of the profiled groove is at a more acute angle to the tangential component of the fiber material flow than the upstream edge (8*b*).

15 Claims, 2 Drawing Sheets

SCREEN PIPE FOR DRY FORMING WEB MATERIAL

This is a continuation of international application Ser. No. PCT/US00/14631, filed May 26, 2000, published as WO 00/73032 in the English language, the entire disclosure of which is hereby incorporated by reference.

FIELD OF THE INVENTION

The present invention relates to an apparatus which may be used for the rapid and even distribution of fibrous material onto a moving surface for the formation of web material.

BACKGROUND OF THE INVENTION

There are several techniques for the formation of fibrous sheets as webs. Wet-laying is a process by which a liquid suspension containing fibers to be incorporated into a sheet is filtered through a sieve. The fibers in the liquid suspension are laid onto the sieve as the water passes through thereby creating the sheet. This process is most useful for the creation of thin, non-absorbent sheets such as paper. Another well known process is dry-forming. This process involves the suspension of fibers which are to form a fibrous sheet, in air. These fibers are then laid onto a wire screen across which a vacuum is applied to draw the fibers onto the screen and hold them in place. This technology is particularly useful in the production of absorbent products.

There are several dry-forming techniques known in the art. However, a common problem associated with dry-forming fibrous webs is the difficulty in creating an even distribution of the fibers across the web. This problem manifests in the industrial production of dry-formed fibrous webs wherein the fibers are laid continuously on a rapidly moving conveyer belt. The present invention embodies an apparatus to overcome this problem.

The invention relates to a screen pipe used in the dry forming of web material to distribute fiber material blown into the screen pipe through a jacket onto a wire screen arranged to move under the pipe. The fiber material provided inside the screen pipe is made to rotate for example by means of a spiked roll placed inside the jacket, so that the movement of the fiber material has both a radial and a tangential component with respect to the jacket of the screen pipe. The jacket includes, on its inner surface, profiled grooves extended axially along the pipe. The edges of the profiled groove with respect to the tangential component of the fiber flow are positioned at different angels to the tangential component. The bottoms of the profiled grooves include holes or slots through which the fibers are discharged from the screen pipe.

A distribution unit where a screen pipe, as described above, can be used is known for example from Finnish Patent 66,948. This patent describes the basic structure of a distribution unit typically used in dry forming of sheet material. The distribution unit, generally called a former, comprises screen pipes, as described above, placed preferably in pairs to provide fiber flow in opposite directions over the wire in the cross direction thereof. The primary reason for such positioning of the pipes is that, in practice, it is virtually impossible to ensure that fiber flow, which occurs only in one direction over the wire, is deposited evenly onto the wire in the cross direction, thus providing a uniform cross direction web profile. When screen pipes are placed in pairs so that the fiber flows in the pipes in opposite directions, a web's cross direction profile can be made considerably more uniform. For a web to be of uniform quality, the variation in the web thickness in the cross direction thereof should be minimal. An acceptable deviation from a target thickness is typically ±5%.

It has proved to be difficult to provide an even cross direction profile with the distribution unit described in Finnish Patent 66,948, despite the use of screen pipes in pairs. However, the basic structure of the distribution unit is useful and provides a high fiber discharge rate also with rather long fibers.

A screen pipe including, on its inner surface, axial profiled grooves wherein the edge of the groove that is located downstream of the tangential component of the fiber flow and the edge of the groove located upstream of the tangential component are at different angles to the tangential component, is known for example from PCT application WO87/04474. In a screen pipe disclosed in the aforementioned publication, fiber material is caused to move by means of a rotor or a spiked roll placed axially inside the pipe. The rotor or roll rotates in such a direction that the fibers whose movement it activates first come across the edge of the profiled groove which is at a more obtuse angle to the tangent of the jacket than the upstream edge of the groove. This method produces microturbulence, which improves the flow of fibers through holes or slots provided in the screen pipe.

A primary problem with the aforementioned arrangement is the capacity at which fibers can be fed through the screen pipe. The higher the desired wire speed and thus the rate of web formation, the higher the required capacity of the distribution units. The present invention overcomes the disadvantages of uneven fiber distribution and low fiber feed capacity.

SUMMARY OF THE INVENTION

The present invention relates to a screen pipe for the expulsion of fibrous material from said screen pipe including a cylindrical screen jacket which may rotate in a single given direction during its normal mode of operation, which includes the following elements on its inner surface:(a) one or more slots which completely penetrate the jacket through which the fibrous material may exit the apparatus; and (b) a groove located immediately downstream of the slot, relative to the direction of rotation of the screen jacket, wherein the edge of the groove which faces the adjacent slot forms an angle with the tangent of the screen jacket between 100° and 160°; and (c)a second groove located immediately upstream of the slot, relative to the direction of rotation of the screen jacket, wherein the edge of the groove which faces the slot forms an angle with the tangent of the screen jacket between 70° and 110°. This screen pipe may further comprise a feed pipe, rotatable brush rollers and a blade wheel. The edges of the grooves may also be substantially straight or curved. The screen pipes of the invention may also be employed in oppositely oriented pairs for dry forming web material. Furthermore, the screen pipe may be operated such that the screen jacket is not rotated.

DETAILED DESCRIPTION OF THE PREFERRED EMBODIMENTS

The term "fibrous material" refers to substantially individualized fibers. Preferred fibers include natural and synthetic fibers, most preferably cellulose fibers.

A "slot" is a hole or any conveyance in the screen jacket of a screen pipe via which fibrous material is expelled.

A "wire" refers to a mesh structure onto which the fibrous material is deposited once expelled from the screen pipe. A wire may be also have a vacuum placed across it so as to aid in the deposition of fibrous material upon it.

The present invention will be better understood by reference to the following figure descriptions which are intended as illustrative of the invention and not limiting thereof.

Figure 1:
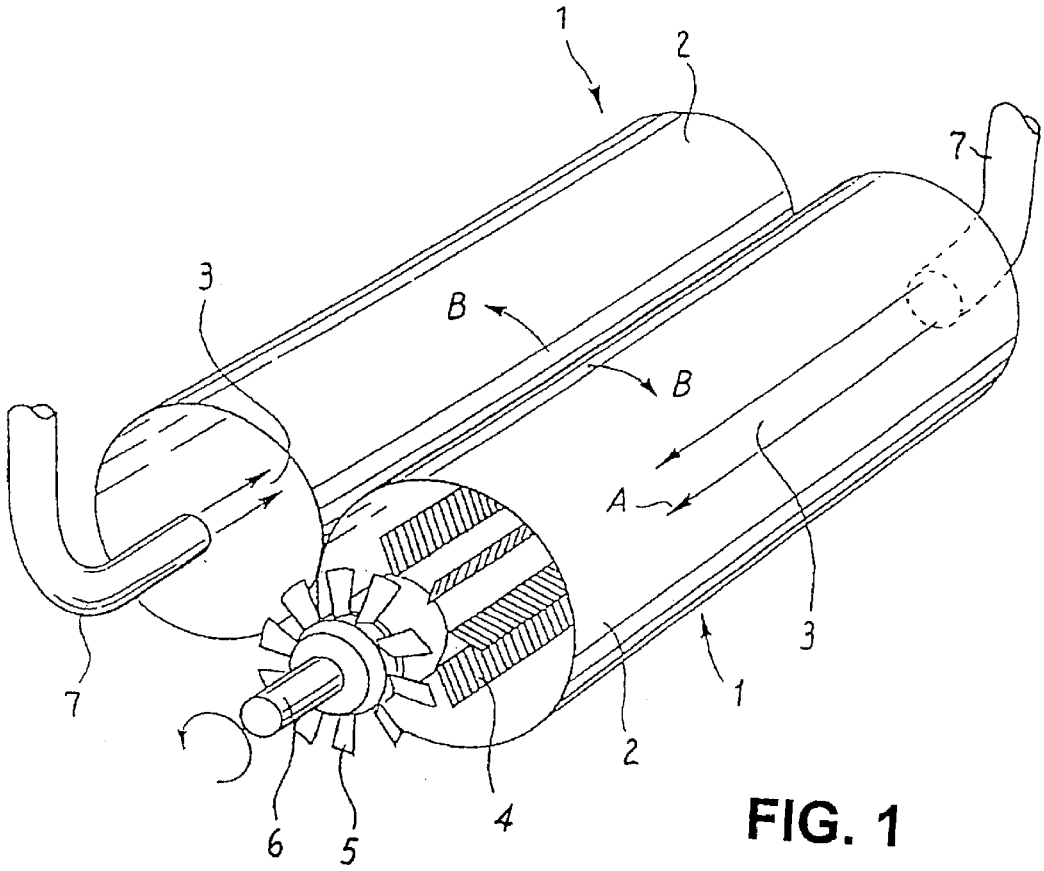
FIG. 1: Basic structure of screen pipe as part of a distribution unit.

FIG. 1 shows the basic structure of an exemplary distribution unit comprising a screen pipe 1 according to the invention. It shows two screen pipes 1 arranged to extend transversely across a wire (not shown in the figure). In FIG. 1, the screen pipes 1 are arranged in a pair so that the flow directions A of the fiber material 3 in the pipes are opposite. This is achieved by blowing a fiber material flow 3 into the pipes via feed pipes 7 arranged at opposite ends of the screen pipes. The feed pipes direct substantially axial flows of fiber material in an air-fluidized state into the screen pipes. Screen jackets 2 may be arranged to be rotated around their axes in the direction denoted by arrow B. Alternatively, the screen jackets 2 maybe arranged to remain static while the fibrous material inside said screen jacket is rotated in the direction denoted by arrow C. In preferred embodiments, the screen jacket 2 is caused to rotate in the direction denoted by arrow B and the fibrous material is caused to be rotated in the direction denoted by arrow C.

The screen pipes may also include brush rollers 4 arranged inside the pipes in a conventional manner, as disclosed in Finnish Patent 66,948. The purpose of the brush rollers is to clean the jacket surfaces 2 of the screen pipes 1 and to improve the penetration of fibers through the openings or slots in jackets 2. When rotating, the brush rollers 4 may also function to actively rotate the injected fibrous material within the screen jacket 2. The structure of the brush rollers is conventional and known for example from the aforementioned Finnish Patent.

In the distribution unit of FIG. 1, a blade wheel 5 may be arranged inside the screen pipe 1 at the end opposite to the end where the fibers are input. The purpose of the blade wheel is to slow down the fiber flow 3 inside the screen pipe 1. A slower flow of fibers especially at the end of the screen pipe comprising the blade wheel enables fibers to be discharged through the jackets more evenly than previously along the entire length of the screen. This positive effect is most visible at the end of the screen pipe comprising the blade wheel. When the screen pipes are arranged in pairs as described in the illustrative embodiment shown in the drawing, so that the fiber material flows in opposite directions inside the pipes, the blade wheel provided in the other screen pipe slows down the flow and enables fiber material to be layered also onto the other margin of the web material to be formed. This provides a more even cross direction profile of the web than previously along the entire width thereof.

Figure 2:
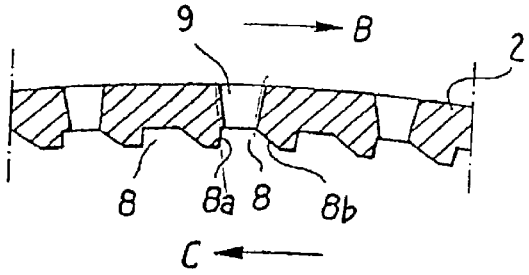
FIG. 2: Partial cross-sectional view of a jacket of the screen pipe.

FIG. 2 shows a cross-section of the jacket provided in an illustrative embodiment of the screen pipe according to the invention. The direction in which the screen pipe is rotated is denoted by arrow B, and the direction in which a spiked roll 4 provided inside the jacket 2 is rotated is denoted by arrow C. As shown in the figure, the arrows are opposite in direction to one another. However, the essential feature of the screen pipe according to the invention is the direction in which grooves provided in the jacket meet the fiber flow that is in motion inside the jacket. For the invention to operate as intended, the fibrous material must first encounter the groove with the more obtuse angle before it encounters the groove with the more acute angle. For this to happen, the rate of rotation of the fibrous material inside the screen jacket must be less than that of the screen jacket in the direction in which the screen jacket is rotating. This may be brought about by actively rotating both the screen jacket and the fibrous material, in opposite directions. This is the most preferred embodiment of the invention. However, the present application also contemplates embodiments wherein only the screen jacket is actively made to rotate. In this case the fibrous material inside the screen jacket will rotate somewhat due to frictional forces with the inner surface of the screen jacket. However, in this embodiment, the screen jacket will rotate at a higher rate than the fibrous material thereby causing the fibrous material to encounter the groove with the more obtuse angle before it encounters the groove with the more acute angle. Furthermore, both the screen jacket and the fibrous material may be actively made to rotate in the same direction. In this embodiment, the screen jacket must be made to rotate at a higher rate than that of the fibrous material. The present invention also contemplates embodiments in which the screen jacket is not rotating but dry fibrous material inside the screen jacket is rotating. In these embodiments, the fibrous material must rotate in a direction such that said fibrous material encounters the more obtuse angle groove before encountering the more acute angle groove. In embodiments wherein fibrous material is actively made to rotate in a given direction (i.e. by means other than, for example, by frictional forces between the fibrous material and the screen jacket inner wall alone) any component capable of causing this rotation without disabling the essential elements of the invention is suitable. Preferred embodiments include the use of brush rollers 4 to actively rotate the fibrous material.

In the invention, axial grooves 8 provided in the jacket 2 of the screen pipe are asymmetrical such that the edge 8*a* of the groove that is situated downstream with respect to the direction of rotation C of the fibrous material is at a more acute angle to the tangent of the jacket than the upstream edge 8*b* of the groove. As shown in FIG. 2, the angle of the downstream edge 8*a* of the profiled groove to the tangent of the jacket is perhaps most preferably about 90°, or more generally in the range of from 70° to 110°, and the angle of the upstream edge 8*b* of the profiled groove to the jacket tangent is perhaps most preferably about 130°, or more generally in the range of from 100° to 160°. In preferred embodiments, the grooves and slots extend in linear arrays along the longitudinal axis of the screen jacket. The grooves adjacent to a particular linear array of slots are continuous with each other and extend parallel to the linear array of slots. In this embodiment a groove which is adjacent to a particular linear array of slots forms a single protuberance which rises from the inner wall of the screen jacket. This arrangement is in contrast to an embodiment wherein the grooves adjacent to an array of slots are discontinuous and have a punctate appearance; this embodiment is also within the scope of the invention.

Figure 3:
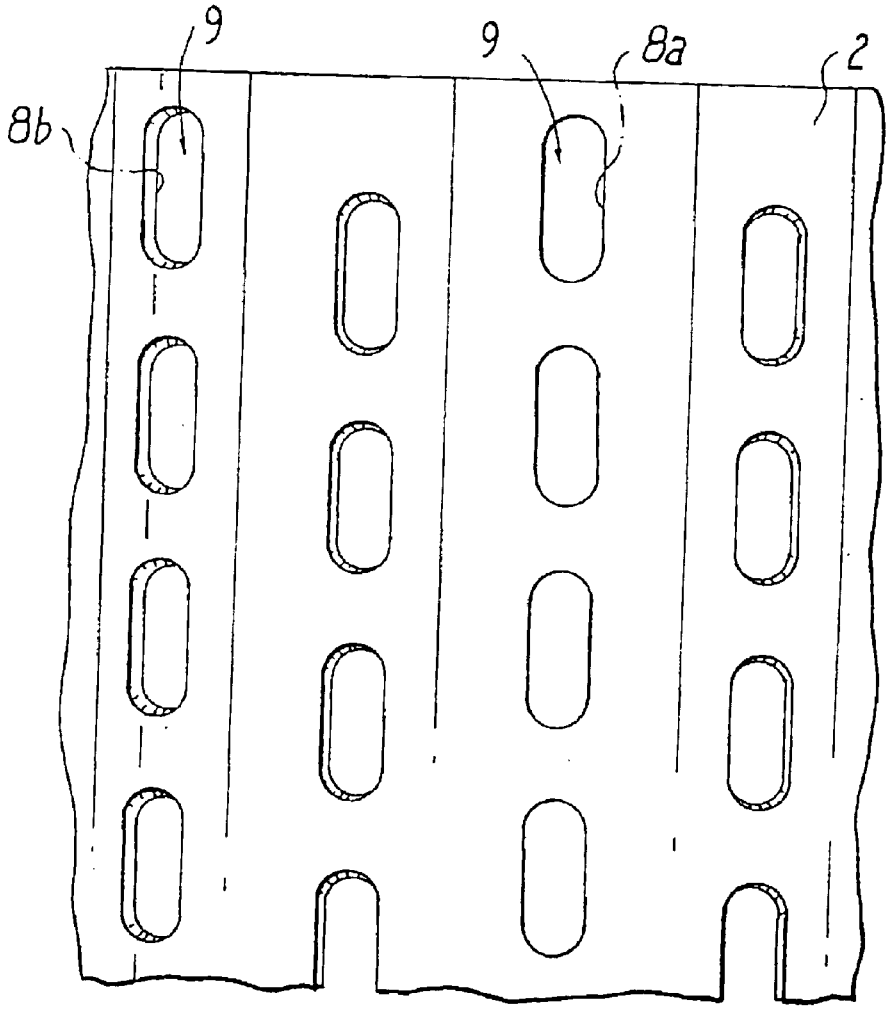
FIG. 3: Shows a partial cross-sectional view of one embodiment of the inside surface of the jacket.

With reference to FIG. 3, the grooves of this invention extend along the longitudinal axis of the screen pipe at least as far as that of the slots. In preferred embodiments, the grooves do not extend along the entire length of the longitudinal axis, nor do the slots; however, embodiments wherein the slots and grooves do extend along the entire length of the axis are within the scope of this invention.

The purpose of the profile asymmetry is to provide strong microturbulence and thus good formation, i.e. even distribution of fibers as a function of area, and also good capacity in dry formation. The groove profile which generates strong microturbulence prevents the formation of a phenomenon known as a fine sieve, so that even rather long fibers are able to move through the jacket at high efficiency. The arrangement is particularly useful with synthetic staple fibers and it is also suitable for chemical pulp fibers.

Holes or slots 9 via which the fibers are discharged from the screen pipe 1 are situated at the bottom of the profiled grooves 8. In the embodiment of FIG. 2, and in preferred embodiments, the holes or slots have a size of 3 to 4.5 mm or 1.5 to 2 mm×30 mm. These slots are shown at the same cross-sectional point at the bottom of every other groove. The total area of the holes or slots with respect to the entire area of the jacket may vary considerably, and it is usually a few dozen percent, such as about 25%. The thickness of the jacket 2 can vary for example between 3 and 5 mm. The screen jacket is composed of stainless steel in preferred embodiments. However, other embodiments include screen jackets made of other metals. Other nonmetal materials of sufficient strength to withstand the stress is of the normal operation of the screen pipe are also possible embodiments of the invention, these materials may include composite plastics or fiberglass.

Figure 4:
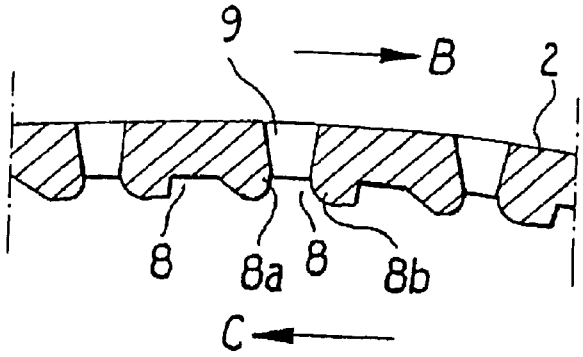
FIG. 4: Shows a partial cross-sectional view of another embodiment of the jacket.

In FIG. 2, the edges 8*a* and 8*b* of the profiled grooves are shown to be substantially straight, but they can also be curved as shown in FIG. 4. In such a case the angle of the edges to the jacket tangent would be determined by a line segment that connects the edge of the profiled groove which faces the hole or slot with the edge of the hole or slot 9 situated at the bottom of the groove nearest to the aforementioned edge of the groove. Therefore the shape of the groove profile in the screen pipe according to the invention can be modified without deviating from the scope of protection defined in the appended claims and from the basic idea of the invention, wherein the downstream edge of the groove is steeper than the upstream edge of the groove.

The cylindrical shape of the screen jacket of the screen pipe refers to the general shape of the jacket. The invention contemplates minor or superficial alterations to the jacket which would have the effect of making the jacket less than a perfect cylinder.

The screen jacket of any particular screen pipe rotates in only a single direction during its normal operation. This direction of rotation in always such that the grooves comprising the more acute angle relative to the tangent of the rotational path of the slot are upstream of the slot and the grooves comprising the more obtuse angle.

The present application contemplates screen pipes comprising screen jackets configured such that they may rotate in a clockwise direction and screen pipes comprising screen jackets configured such that they may rotate in a counterclockwise direction.

What is claimed is:

1. A screen pipe for distributing fibrous material, comprising: a cylindrical screen jacket rotatable about its longitudinal axis, the wall of said jacket including:

(a) one or more slots which completely penetrate the jacket through which the fibrous material may penetrate;

(b) a first groove located downstream and adjacent to the slot, relative to the direction of rotation of the screen jacket, wherein the edge of said first groove forms an angle with the tangent of the screen jacket of between 100° and 160°; and (c) a second groove located upstream and adjacent to the slot, relative to the direction of rotation of the screen jacket, wherein the edge of said second groove forms an angle with the tangent of the screen jacket of between 70° and 110°.

2. The screen pipe of claim 1 further comprising one or more components selected from the group consisting of:

(a) a feed pipe through which fibrous material is injected into the screen pipe;

(b) rotatable brush rollers which are affixed to a cylinder inside the screen pipe; and (c) a blade wheel which is affixed to a cylinder inside the screen pipe.

3. A screen pipe according to claim 1, wherein the edges of the profiled grooves are substantially straight.

4. A screen pipe according to claim 1, wherein the edges of the profiled grooves are curved, and the angle of the groove edges to the jacket tangent is thus determined by a line segment that connects the edge of the groove with the edge of the hole or slot situated at the bottom of the groove nearest to said edge of the groove.

5. An apparatus for the dry forming of web material comprising two screen pipes of claim 1 wherein the screen pipes are oriented at 180° angles to each other.

6. A method of operation of the screen pipe of claim 1 wherein the screen jacket is not rotated during its operation.

7. A screen pipe for distributing fibrous material from said screen pipe comprising a cylindrical screen jacket including;

(a) one or more slots which completely penetrate the jacket through which the fibrous material may penetrate;

(b) a first groove located upstream and adjacent to the slot, relative to the direction of rotation of the fibrous material, wherein the edge of the groove which faces the slot forms an angle with the tangent of the screen jacket between 100° and 160°;

(c) a second groove located downstream and adjacent to the slot, relative to the direction of rotation of the fibrous material wherein the edge of the groove which faces the slot forms an angle with the tangent of the screen jacket between 70° and 110°; and (d) means capable of causing the rotation of fibrous material about the axis of the screen jacket.

8. The screen pipe of claim 7 further comprising one or more components selected from the group consisting of:

(a) a feed pipe through which fibrous material is injected into the screen pipe;

(b) rotatable brush rollers which are affixed to a cylinder inside the screen pipe; and (c) a blade wheel which is affixed to a cylinder inside the screen pipe.

9. A screen pipe according to claim 7, wherein the edges of the profiled grooves are substantially straight.

10. A screen pipe according to claim 7, wherein the edges of the profiled grooves are curved, and the angle of the groove edges to the jacket tangent is thus determined by a line segment that connects the edge of the groove with the edge of the hole or slot situated at the bottom of the groove nearest to said edge of the groove.

11. An apparatus for the dry forming of web material comprising two screen pipes of claim 7 wherein the screen pipes are oriented at 180° angles to each other.

12. A screen pipe to be used in dry forming of web material in order to distribute fiber material (3) blown into the screen pipe (1) through a jacket (2) of the pipe onto a wire arranged to move under the pipe, the fiber material provided inside the screen pipe (1) being made to move for example by means of a spiked roll (4) placed inside the pipe, so that the movement of the fiber material has both a radial and a tangential component with respect to the jacket (2) of the screen pipe, which jacket comprises on its inner surface profiled grooves (8) in the pipe's axial direction, the edge **(8*a*) of the profiled groove that is situated downstream with respect to the tangential component of the fiber flow and the upstream edge (8*b*) of the groove being positioned at different angels to said tangential component, and the bottoms of the profiled grooves comprising holes or slots (9) via which the fibers are discharged from the screen pipe (1), characterized in that the downstream edge (8*a*) of the profiled groove is at a more acute angle to the tangential component of the fiber material flow than the upstream edge (8*b*), characterized in that the angle of the downstream edge (8*a*) of the profiled groove to the jacket tangent is approximately between 70° and 110°, and the angle of the upstream edge (8*b*)** of the profiled groove to the jacket tangent is about 100° to 160°,.

13. A screen pipe to be used in dry forming of web material in order to distribute fiber material (3) blown into the screen pipe (1) through a jacket (2) of the pipe onto a wire arranged to move under the pine, the fiber material provided inside the screen pipe (1) being made to move for example by means of a spiked roll (4) placed inside the pipe, so that the movement of the fiber material has both a radial and a tangential component with respect to the jacket (2) of the screen pipe, which jacket comprises on its inner surface profiled grooves (8) in the pipe's axial direction, the edge **(8*a*) of the profiled groove that is situated downstream with respect to the tangential component of the fiber flow and the upstream edge (8*b*) of the groove being positioned at different angels to said tangential component, and the bottoms of the profiled grooves comprising holes or slots (9) via which the fibers are discharged from the screen pipe (1), characterized in that the downstream edge (8*a*) of the profiled groove is at a more acute angle to the tangential component of the fiber material flow than the upstream edge (8*b*)**.

wherein the edges of the profiled grooves are curved, and the angle of the groove edges to the jacket tangent is thus determined by a line segment that connects the edge of the groove with the edge of the hole or slot (9) situated at the bottom of the groove nearest to said edge of the groove.

14. A screen pipe for distributing fibrous material, comprising: a cylindrical screen jacket rotatable about its longitudinal axis, the wall of said jacket including:

(a) a linear array of two or more slots extending along the longitudinal axis of the screen jacket completely penetrating the jacket through which the fibrous material may penetrate;

(b) a first groove extending parallel to the linear array of slots and located downstream and adjacent to the linear array of slots, relative to the direction of rotation of the screen jacket, wherein the edge of said first groove forms an angle with the tangent of the screen jacket of between 100° and 160°; and (c) a second groove extending parallel to the linear array of slots and located upstream and adjacent to the slot, relative to the direction of rotation of the screen jacket, wherein the edge of said second groove forms an angle with the tangent of the screen jacket of between 70° and 100°.

15. A screen pipe according claim 12, wherein the angle of the downstream edge **(8*a*) of the profiled groove to the jacket tangent is about 90°, and the angle of the upstream edge (8*b*)** of the profiled groove to the jacket tangent is about 130°.

* * * * *